US006886660B2

(12) United States Patent
Sapatova

(10) Patent No.: US 6,886,660 B2
(45) Date of Patent: May 3, 2005

(54) SLIP-RESISTANT STEP STOOL AND A METHOD OF MANUFACTURING THE SAME

(75) Inventor: Elena Sapatova, Copley, OH (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 10/446,278

(22) Filed: May 23, 2003

(65) Prior Publication Data

US 2003/0217889 A1 Nov. 27, 2003

Related U.S. Application Data

(60) Provisional application No. 60/382,720, filed on May 23, 2002.

(51) Int. Cl.[7] ..... A47C 13/00; E06C 7/00

(52) U.S. Cl. ..... 182/33; 182/228.2; 264/259

(58) Field of Search ..... 182/33, 21, 129, 182/28, 46, 228.2, 228.1; 297/462, 461, 452.26; 52/177; 264/259, 328.1, 328.14, 319

(56) References Cited

U.S. PATENT DOCUMENTS

| | | | | |
|---|---|---|---|---|
| 3,271,075 A | | 9/1966 | Good | 297/439 |
| 4,383,488 A | | 5/1983 | Macho et al. | 108/129 |
| 4,618,030 A | * | 10/1986 | Campbell | 182/121 |
| 4,699,832 A | * | 10/1987 | Sattelmeyer | 428/36.8 |
| 5,475,951 A | * | 12/1995 | Litzow | 52/177 |
| 5,503,245 A | * | 4/1996 | Etesam | 182/129 |
| 5,579,864 A | | 12/1996 | Shorrock | 182/113 |
| 5,641,034 A | | 6/1997 | Calmeise et al. | 182/33 |
| 5,645,511 A | | 7/1997 | Le Roux et al. | 482/52 |
| 5,692,581 A | * | 12/1997 | Nelson et al. | 182/129 |
| 5,744,210 A | * | 4/1998 | Hofmann et al. | 264/328.1 |
| 5,763,070 A | * | 6/1998 | Kerlek et al. | 428/329 |
| 6,131,700 A | * | 10/2000 | Farner | 182/222 |
| 6,176,962 B1 | * | 1/2001 | Soane et al. | 156/292 |
| 6,237,523 B1 | * | 5/2001 | Day et al. | 114/362 |

OTHER PUBLICATIONS

PCT International Search Report issued in PCT/US03/16621, Aug. 8, 2003.

PCT International Written Opinion issued in PCT/US03/16621, mailed Mar. 16, 2004.

International Preliminary Examination Report, dated Aug. 23, 2004, for International Application No. PCT/US03/16621.

* cited by examiner

*Primary Examiner*—Hugh B. Thompson, II

(74) *Attorney, Agent, or Firm*—Marshall, Gerstein & Borun LLP

(57) ABSTRACT

A slip resistant step stool includes a step surface with four legs extending downward. A slip resistant surface is bonded to the step surface. The slip resistant surface may be disposed in a pocket and have a ridge surrounding it. The slip resistant surface can be a thermoplastic elastomer. The stool can be manufactured by inserting the slip resistant surface in a mold adapted to form a step stool, then injecting molten resin into the mold, thereby bonding the resin to the slip resistant step stool.

15 Claims, 5 Drawing Sheets

SLIP-RESISTANT STEP STOOL AND A METHOD OF MANUFACTURING THE SAME

CROSS REFERENCE TO RELATED APPLICATIONS

This application claims priority to U.S. Provisional Application 60/382,720, filed on May 23, 2002.

TECHNICAL FIELD

The technical field generally relates to step stools and, more particularly, relates to injection molded step stools having a slip-resistant insert formed thereon.

BACKGROUND

Step stools for commercial and consumer utility are well-known. Such step stools are typically constructed from stamped or otherwise formed metal or from a plastic molded by an injection molding process. Generally, a step stool includes a step portion forming a planar surface supported by a plurality of legs fixedly attached to a bottom surface of the step portion. FIG. 1 illustrates a prior art metal step stool 2 including a step portion 4 having a substantially rectangular configuration. The step portion 4 further includes a plurality of rounded corners 6 and a skirt 8 fixedly attached or integrally formed along the periphery 10 of the support portion 4. The step portion 4 further includes a top surface 12, a bottom surface 14 and a plurality of support legs 16 fixedly attached to the bottom surface 14. The support legs 16 have a substantially circular cross section and extend a uniform distance from the bottom surface 14 such that the bottom surface 14 is substantially parallel to a reference surface such as a floor or other horizontal surface. The support legs 16 further including a footer 18 fixedly attached to an end of the support leg 16*a* distal to the bottom surface 14. The footer 18 may be constructed from any appropriate plastic or rubber material and configured to be firmly attached at the end of the support leg 16*a*. The top surface 12 can be formed to have a variety of configurations including a textured or uneven surface such as a plurality of raised ridges 20*a*–20*c* formed integrally with the top surface 12. The raised ridges 20*a*–20*c* can be formed to provide additional traction for the top surface 12.

FIG. 2 illustrates another embodiment of a prior art metal step stool 2 wherein the top surface 12 includes a non-skid surface 22 fixedly adhered to the top surface 12. The non-skid surface 22 may be a self-adhesive material having a textured or irregular surface 22*a* to provide a high coefficient of friction such that a person using the step stool will not slip or skid on the stool. The non-skid surface 22 may be formed in a substantially rectangular configuration having a plurality of filleted corners 24, as illustrated in FIG. 2, or may be formed as a plurality of longitudinal strips similar to the raised ridges 20*a*–20*c* illustrated in FIG. 1.

Further embodiments of the prior art step stool may include injection molded step stools formed from plastic and resin materials having a configuration substantially similar to the step stool 2 described above. The top surface of the injection molded step stool is often formed with a knurled or a textured surface to provide slip resistance.

DETAILED DESCRIPTION

Figure 1:
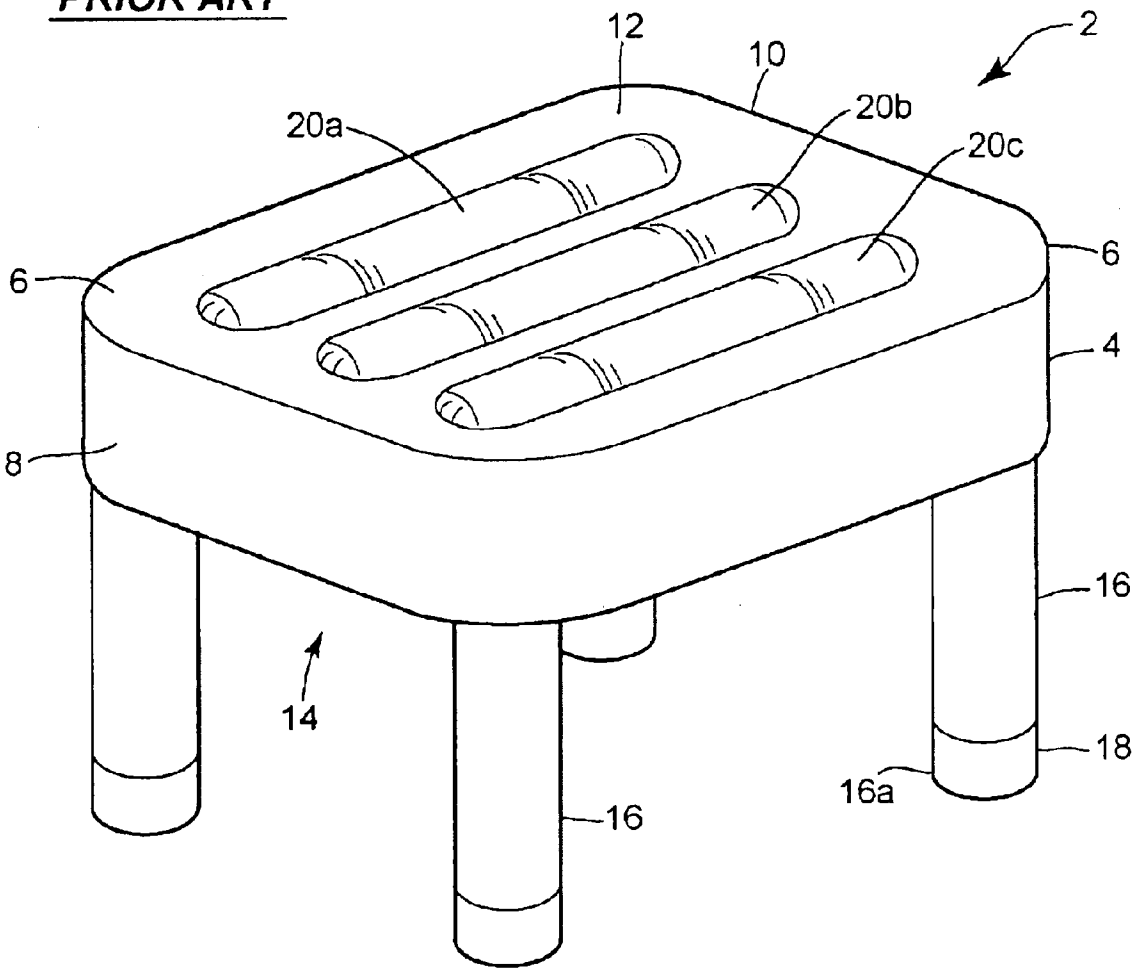
FIG. 1 PRIOR ART
FIG. 1 is a perspective view of a prior art step stool.
Figure 2:
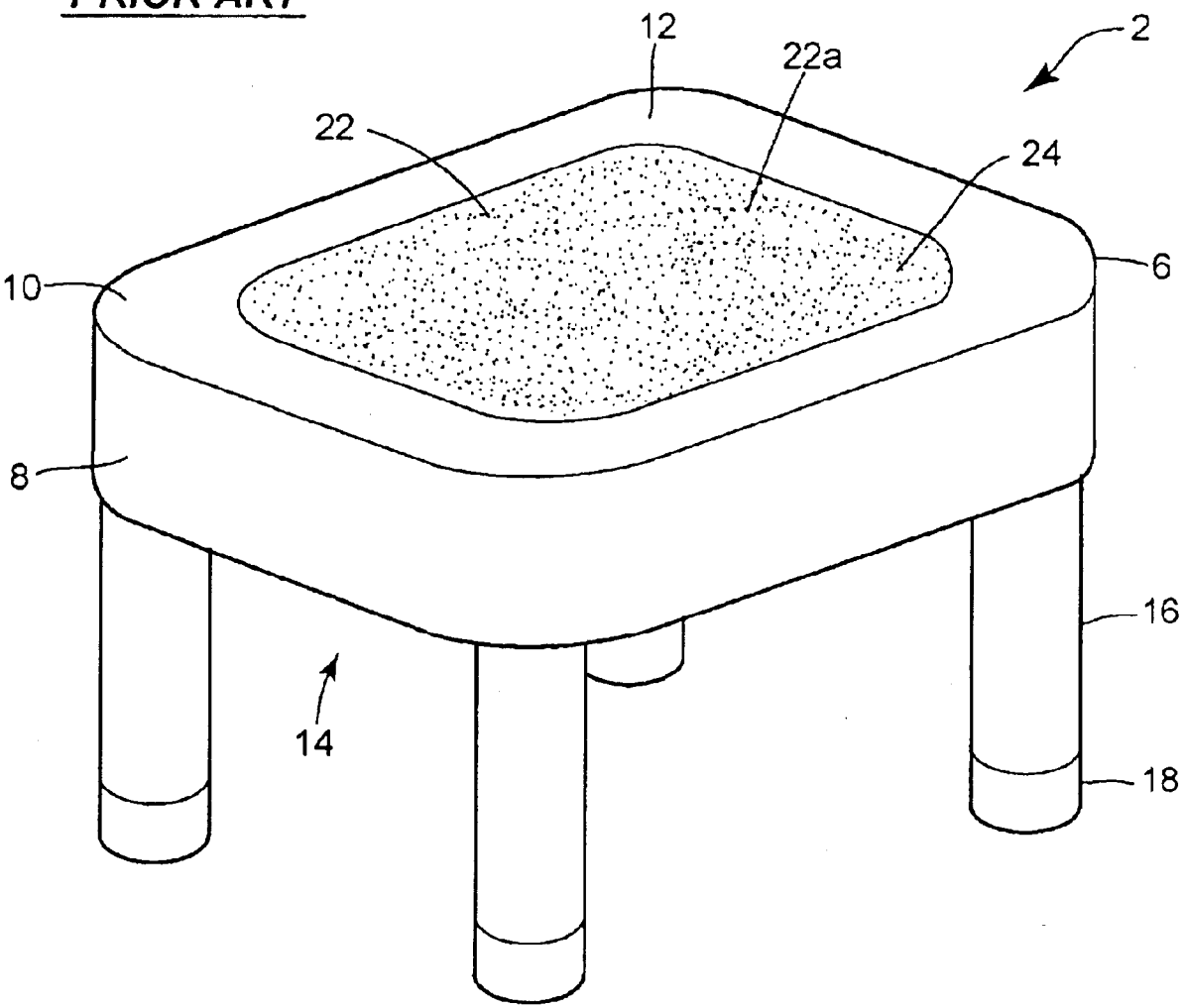
FIG. 2 PRIOR ART
FIG. 2 is a perspective view of another embodiment of the prior art step stool.
Figure 3:
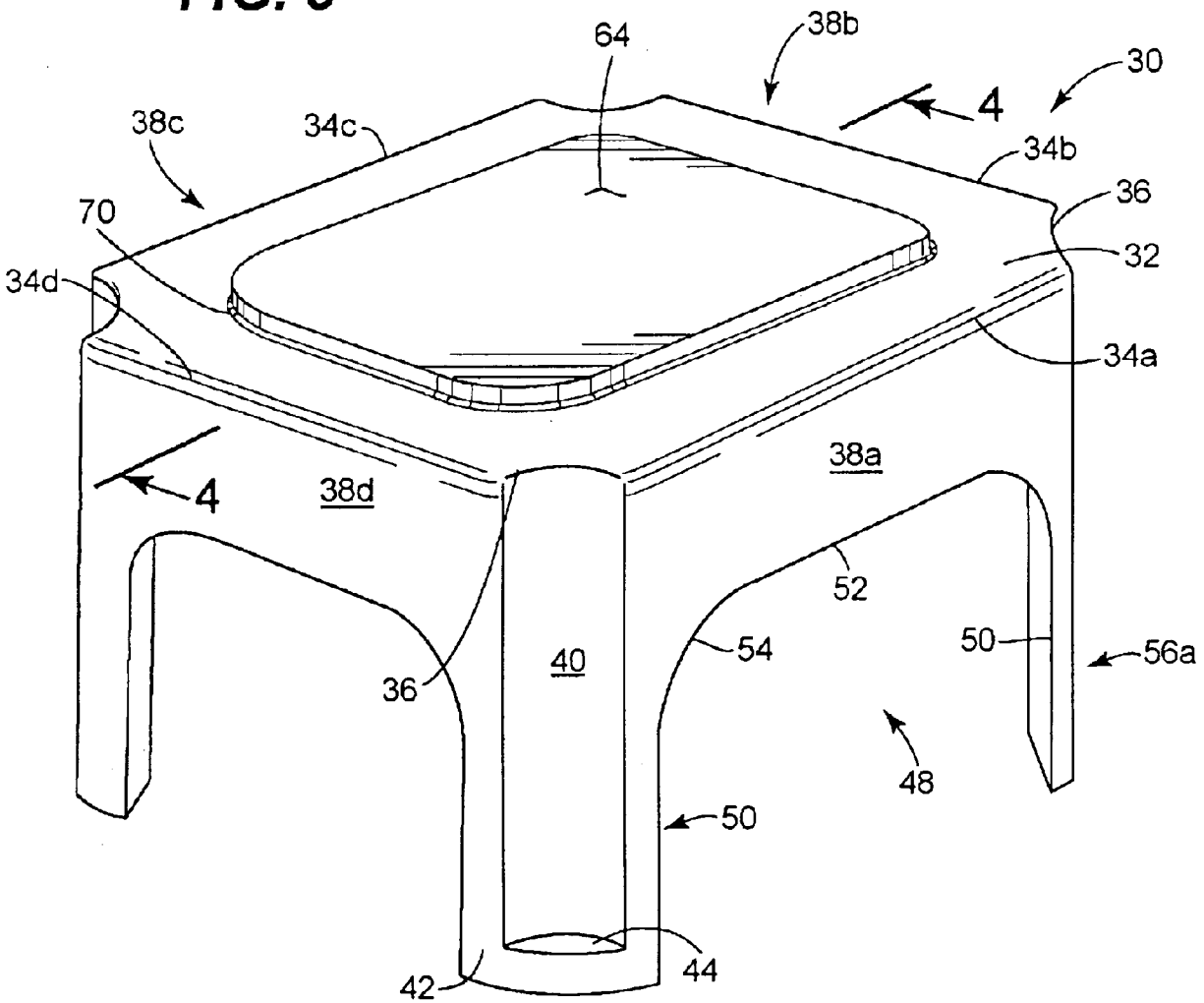
FIG. 3 is a perspective view of a step stool providing a non-skid surface in accordance with the teachings of this disclosure.

FIG. 3 illustrates an injection-molded step stool 30 that includes a support structure 31 and a slip resistant surface 64. The support structure 31 has a step surface 32 with a substantially rectangular configuration. The rectangular step surface 32 has a plurality of edges 34*a*–34*d* wherein each of the edges is connected by a concave edge 36 located proximately to the intersection of any two of the edges 34*a*–34*b*, 34*b*–34*c*, 34*c*–34*d*, 34*d*–34*a*, respectively. A plurality of side-walls 38*a*–38*d* may be formed adjacent to the edges 34*a*–34*d*, wherein the side walls 38*a*–38*d* are aligned generally orthogonal to a plane defined by the step surface 32. The plurality of edges in this example have a smooth transition or radius between the top surface 32 and the side-walls 38*a*–38*d*. These sidewalls 38*a*–38*d* can be arranged to define a downwardly depending skirt for the step surface 32.

In this example, the side-walls 38*a*–38*d* are interconnected, each in the same fashion as the edges 34*a*–34*d*, by legs 56, each having a concave surface 40, respectively, located proximate to the intersection of any two of the side-walls and extending downward a greater distance than the remaining portions of the sidewalls 38*a*–38*d*. Each concave surface 40 terminates at a convex footer 42. The convex footer 42 transitions to each concave surface 40 at a ledge surface 44 formed substantially parallel to the step surface 32. Each side-wall 38*a*–38*d* and its adjacent concave surfaces 40 define a cut-out generally indicated by the numeral 48. The cutout 48 comprises a pair of substantially parallel edges 50 of the adjacent respective concave surfaces 40 that intersect a transverse edge 52 via a pair of curved corners 54. The above structure of a single leg 56 has been described herein for the sake of brevity, but one skilled in the art will understand that the structure is exemplary of the construction of the remaining legs 56.

Figure 4:
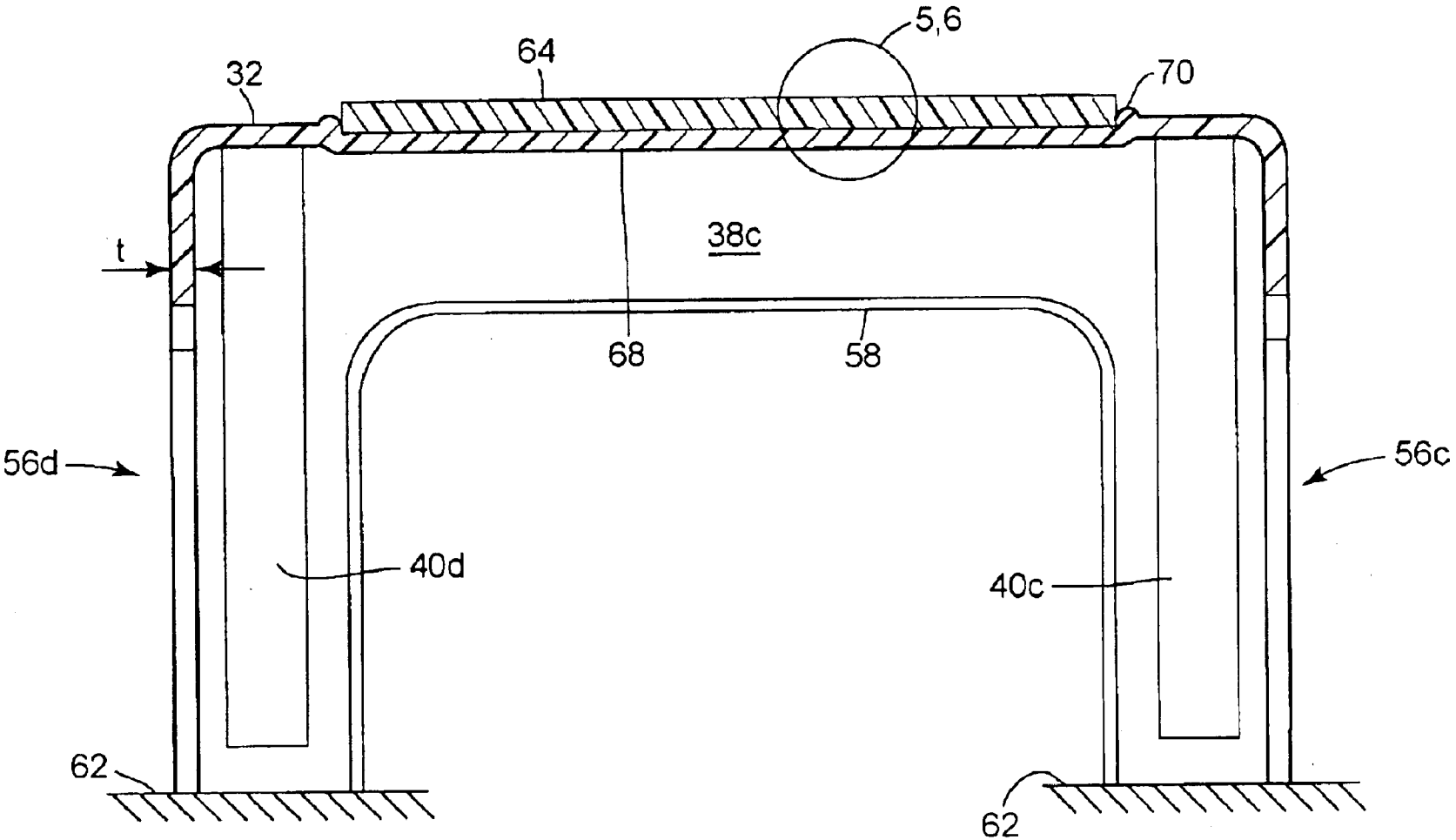
FIG. 4 is a sectional view of the step stool taken along the line 4—4.

FIG. 4 illustrates a cross-sectional view of the step stool 30 described above. An interior surface of the side-wall 38*c* and the concave surfaces 40 are illustrated. The side-walls 38*b*, 38*d* and the step surface 32 are illustrated having a thickness "t." A bead 58 can circumnavigate each cut-out 48 providing a strengthened edge. As shown in FIG. 4, the stool 30 may be positioned on a reference surface 62 such as the floor of a house.

Disposed on top of the step surface 32 is a slip-resistant surface 64 that provides a high friction surface such that a person standing on the stool 30 will be safer and less likely to fall off. The slip resistant surface 64 is disposed in a pocket 68 within the step surface 32. The step surface 32 further includes a ridge 70 circumnavigating the outside edge of the slip resistant surface 64.

The support structure 31 can be manufactured from any of a variety of plastic materials such as polypropylene, polyethylene, acrylonitrile-butadiene-styrene (ABS) plastic, nylon, polyvinyl chloride (PVC) or any other material suitable for use in an injection molding process. Typically, in an injection molding process, a multi-piece mold is constructed defining an inverse representation of the item to be molded. A pressurized melted plastic material, such as the plastics listed above, is injected into the mold to form a completed item. When the melted plastic has sufficiently cooled, the multi-piece mold is separated into its component pieces and the resulting item is removed.

Figure 5:
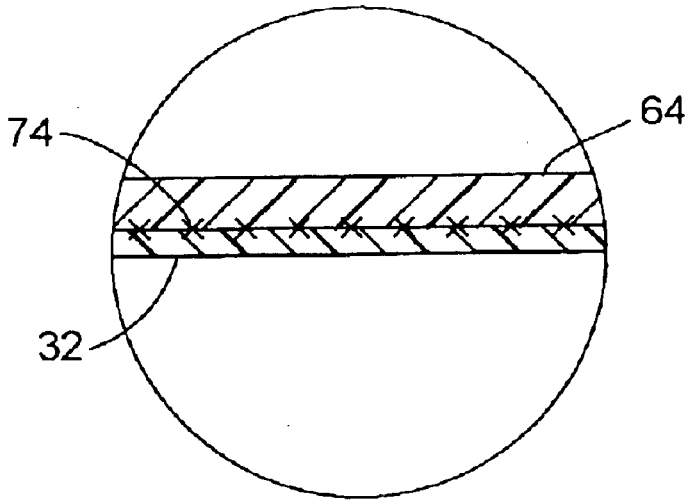
FIG. 5 is an enlarged cross-sectional view of the slip-resistant surface highlighted in FIG. 4.

FIG. 5 illustrates an enlarged view, in a first example, taken from circle 5 in FIG. 4, of the support structure 31 and the slip-resistant surface 64. The slip resistant surface 64 can be manufactured from virtually any thermoplastic elastomer (TPE) or thermoplastic vulcanizate (TPV). SANTOPRENE® thermoplastic elastomer, and VYRAM® thermoplastic elastomer, both manufactured by Advanced Elastomer Systems (AES) of Akron Ohio, styrene-butadiene-styrene (SBS) and ethylene vinyl acetate (EVA) are examples of suitable materials for this application.

First, the slip-resistant surface 64 can be manufactured by extrusion or the like. Extrusion is a process by which raw material, generally in the form of small pellets, or resin, such as SANTOPRENE®, is heated in a chamber to the point where it will flow under moderate pressure and can be extruded through a flat die and subsequently cooled and cut to size to form the slip-resistant surface 64.

Next, the slip-resistant surface 64 can be affixed to the support structure in a number of ways such as insert molding or in-mold labeling. Using insert molding process to form the support structure 31 involves pre-positioning an insert, in this case the slip-resistant surface 64, within a multi-piece mold prior to the injection of melted plastic material. The multi-piece stool mold is generally made up of two vertically separable halves, and a vacuum system or static charger is incorporated to ensure the slip-resistant surface 64 remains in position throughout the formation process. Upon injection of the resin in a liquefied state into the stool mold, the slip-resistant surface 64 and the liquefied resin come into contact. The heat of the melted plastic is transferred to the slip resistant surface 64, thereby slightly melting the slip resistant surface, allowing the two materials to flow within each other, and thereby forming a heat bond or thermoplastic weld 74 between the two materials.

In a first example, it has been found that a slip resistant surface 64 can be created using a high viscosity resin such that the slip resistant surface 64 maintains its integrity and does not flow into the support structure 31 under the heat and pressure of the insert molding process. An example is a slip resistant surface 64 created by a plate extrusion of a mixture of 79.5% VYRAM® grade 9101-45, a thermoplastic elastomer, 15% EXACT® 2101, an ethylene octene copolymer manufactured by Exxon Mobile Chemicals, 5% VECTOR® styrene-isoprene-styrene block co-polymer manufactured by DexCo Polymers, and 0.5% SP 1045, a phenolic resin manufactured by Schenectady International, Inc., each percentage by weight. It is believed that the EXACT® and phenolic resin provide cross-linking action to the VYRAM® to increase its viscosity. Further, the VECTOR® adds to the processability of the extrusion. When this higher viscosity material extruded insert is placed within the stool mold and the molten resin is injected under pressure, the extruded insert does not bleed into the resin. Instead, the extrusion maintains its shape. While this example puts forth specific parameters, it is clear that one skilled in the art would recognize product equivalents. Furthermore, it has been found that the ratios of the ingredients can be varied substantially and the same or substantially similar results can be achieved.

In a second example, a SANTOPRENE® or VYRAM® insert 64 is placed and held within the mold. The hot molten resin is injected under pressure into the mold. In this example, the SANTOPRENE® has been found to bleed into the resin due to the pressure and the heat which in some applications may provide an aesthetically pleasing marbled effect.

In-mold labeling, a process similar to the insert molding, involves pre-positioning a plastic label within the multi-piece mold, and affixing the label to the item while it is still being formed within the multi-piece mold. In this example, the slip-resistant surface 64 can be manufactured of the same material as the support structure 31 or of a substantially homogenous material such that the two components, in the presence of sufficient heat, form a continuous bond 74 with each other. The use of plastic film labels for in-mold labels provide a recycling advantage by allowing the whole item to be reground for reuse without having to remove the label.

Figure 6:
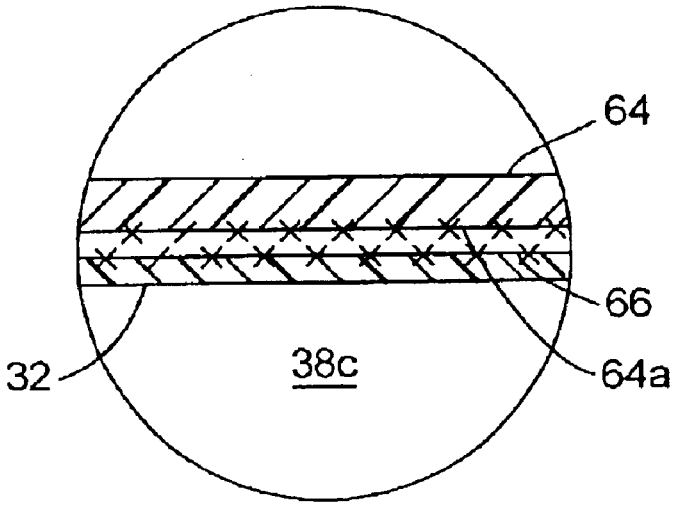
FIG. 6 is an enlarged cross-sectional view of another embodiment of a slip-resistant surface similar to that highlighted in FIG. 4.

Another example of a slip-resistant surface 64 is illustrated in FIG 6. In this example, a separate layer 66, not shown in FIGS. 4 or 5, is used to affix the slip-resistant surface 64 to the step surface 32, whereby the layer 66 operatively connects or adheres the slip-resistant surface 64 to the step surface 32. The layer 66 may be an adhesive applied to an undersurface 64*a* of the slip-resistant surface 64. The adhesive can removably or fixedly join the slip-resistant surface 64 within the pocket 68. Further, the layer can be any other material known in the art to affix materials together. For example, the slip resistant surface 64 and the step surface 32 may be incompatible, and therefore unable to form a heat bond. In this case, it is possible that the layer 66 will be compatible with both, thereby making it possible to bond the incompatible surfaces 32, 64.

Another embodiment provides for the slip-resistant surface 64 to be affixed within the pocket 68 after the formation of the support structure 31 has been completed within the multi-piece mold. During one such post-molding operation, the slip-resistant surface 64 can be affixed using a heat transfer process which combines heat and pressure to thermally bond the slip-resistant surface 64 to the top surface 32, either with or without a layer 66. Another post-molding operation may include coating of the step surface 32 with a slip resistant coating such as a commercially available textured epoxy coating.

In the illustrated examples, only a single slip resistant surface 64 is shown. However, it is clear that a plurality of strips of slip resistant surfaces 64 can used. Further, it is illustrated that a portion of the step surface 32 is covered by the slip resistant surface 64. Additionally, it is illustrated that a majority, or over 50%, of the step surface 32 is covered by the slip resistant surface 64. Others may find it useful to cover the entire step surface 32 with the slip resistant surface 64. Others may find it cost efficient to cover less than the majority of the step surface 32 with the slip resistant surface 64.

While the step stool 30 has been described with reference to specific examples which are intended to be illustrative only and not to be limiting of the invention, it will be apparent to those of ordinary skill in the art that changes, additions or deletions may be made to the disclosed embodiments without departing from the spirit and scope of the invention.

I claim:

1. A slip-resistant step stool, comprising:

a plastic step surface;

a plurality of support legs extending downward from the step surface; and a thermoplastic elastomer slip-resistant surface heat bonded to at least a portion of the step surface, wherein the slip resistant surface is a high viscosity thermoplastic elastomer insert molded or in-molded into the step surface.

2. The stool of claim 1, wherein the step surface further comprises a ridge surrounding the slip resistant surface.

3. The stool of claim 1, wherein the step surface further comprises a pocket in which the slip resistant surface is seated.

4. The stool of claim 1, wherein the slip resistant surface covers a majority of the step surface.

5. The stool of claim 1, further comprising a bonding layer between the slip resistant surface and the step surface.

6. The stool of claim 5, wherein the slip resistant surface is bonded to the step surface with an adhesive.

7. The stool of claim 1, wherein the high viscosity thermoplastic elastomer comprises a thermoplastic elastomer, an ethylene octene copolymer, a styrene-isoprene-styrene block copolymer, and a phenolic resin.

8. A slip-resistant step stool, comprising:

a step surface;

a plurality of support legs extending downward from the step surface; and a high viscosity thermoplastic elastomer slip-resistant surface bonded to at least a portion of the step surface;

wherein the high viscosity thermoplastic elastomer comprises a thermoplastic elastomer, an ethylene octene copolymer, a styrene-isoprene-styrene block copolymer, and a phenolic resin.

9. The stool of claim 8, wherein the slip resistant surface is a high viscosity thermoplastic elastomer insert molded or in-molded into the step surface.

10. The stool of claim 8, wherein the step surface further comprises a ridge surrounding the slip resistant surface.

11. The stool of claim 8, wherein the step surface further comprises a pocket in which the slip resistant surface is seated.

12. The stool of claim 8, wherein the slip resistant surface covers a majority of the step surface.

13. The stool of claim 8, further comprising a bonding layer between the slip resistant surface and the step surface.

14. The stool of claim 13, wherein, the slip resistant surface is bonded to the step surface with an adhesive.

15. The stool of claim 8, wherein the slip resistant surface is heat bonded to the step surface.

* * * * *